US006027015A

United States Patent [19]

Christensen

[11] Patent Number: 6,027,015

[45] **Date of Patent: *Feb. 22, 2000**

[54] ELEVATED BOTTOM CARTON

[75] Inventor: Charles Christensen, Centuria, Wis.

[73] Assignee: Tetra Laval Holdings & Finance, SA, Pully, Switzerland

[ * ] Notice: This patent is subject to a terminal disclaimer.

[21] Appl. No.: 09/128,748

[22] Filed: Aug. 4, 1998

Related U.S. Application Data

[63] Continuation-in-part of application No. 08/955,063, Oct. 21, 1997, which is a continuation-in-part of application No. 09/052,401, Mar. 31, 1998.

[51] Int. Cl.[7] ..... B65D 5/00

[52] U.S. Cl. ..... 229/104; 229/125.42; 229/915.1; 229/184

[58] Field of Search ..... 229/104, 125.42, 229/184, 915.1

[56] References Cited

U.S. PATENT DOCUMENTS

| | | | |
|---|---|---|---|
| 2,142,142 | 1/1939 | Newsom | 229/104 X |
| 2,439,435 | 4/1948 | Richardson et al. | 229/137 |
| 2,523,251 | 7/1950 | Pantalone et al. . | |
| 2,815,164 | 12/1957 | Painter . | |
| 3,275,216 | 9/1966 | Collins . | |
| 3,294,310 | 12/1966 | Miller et al. | 229/137 |
| 3,402,876 | 9/1968 | Kuchenbecker . | |
| 3,412,922 | 11/1968 | Miller et al. . | |
| 4,221,162 | 9/1980 | Kauffman et al. . | |
| 4,313,556 | 2/1982 | Boyle et al. . | |
| 4,332,577 | 6/1982 | Mosse . | |
| 4,589,862 | 5/1986 | Murrah . | |
| 4,601,425 | 7/1986 | Bachner . | |
| 4,776,830 | 10/1988 | Fujikawa et al. . | |
| 4,838,847 | 6/1989 | Kume et al. . | |
| 4,986,058 | 1/1991 | Carlsson et al. . | |
| 4,990,128 | 2/1991 | Murrah . | |
| 5,056,707 | 10/1991 | Larsen | 229/104 |
| 5,120,292 | 6/1992 | Ueda et al. . | |
| 5,152,736 | 10/1992 | Owen et al. . | |
| 5,167,607 | 12/1992 | Larsen . | |
| 5,222,667 | 6/1993 | Fujikawa et al. | 229/137 |
| 5,232,146 | 8/1993 | Antonacci . | |
| 5,234,398 | 8/1993 | Larsen . | |
| 5,295,941 | 3/1994 | Fujikawa et al. . | |
| 5,845,840 | 12/1998 | Johansson et al. | 229/104 |

FOREIGN PATENT DOCUMENTS

| | | |
|---|---|---|
| 0112553 | 12/1982 | European Pat. Off. . |

*Primary Examiner*—Gary E. Elkins
*Assistant Examiner*—Tri M. Mai
*Attorney, Agent, or Firm*—Welsh & Katz, Ltd.

[57] ABSTRACT

A carton having a primary elevated bottom portion extending along the length of an exposed raw paperboard edge to protect the carton and to prevent moisture absorption. The carton also having a secondary elevated bottom portion substantially within the primary elevated portion and having an elevation greater than the primary elevated bottom portion. Additional elevated portions are provided for additional raw paperboard edges on the bottom of the carton. The present invention alleviates the problem of cartons having soggy bottoms since the point of absorption, the raw paperboard edge, is elevated above the moisture which may be present during distribution from the packaging machine to the retailer. The elevated bottom portion is actually inverted into the carton with planar portions resting on the surface to support the carton.

21 Claims, 4 Drawing Sheets

ELEVATED BOTTOM CARTON

CROSS REFERENCES TO RELATED APPLICATIONS

This is a continuation-in-part application of U.S. patent application Ser. No. 08/955,063 filed on Oct. 21, 1997 which is a c-i-p of U.S. patent application Ser. No. 09/052,401 filed on Mar. 31, 1998, which are both hereby incorporated by reference.

BACKGROUND OF THE INVENTION

1. Field of the Invention

The present invention relates to a carton having an elevated bottom. Specifically, the present invention relates to a carton having the edge portions of the bottom elevated to protect the raw paperboard edges from damage and absorption of moisture.

2. Description of the Related Art

Cartons fabricated from a carton blank on a form, fill and seal packaging machine risk absorption of moisture into the raw paperboard edges of the bottom of the carton. This absorption is accelerated if the raw paperboard edges are damaged and the carton is continuously exposed to moisture. The transportation, loading and storage of the carton from the conveyance between the packaging machine/packer unit and the retailer display are all sources for damage and moisture absorption.

The raw paper edges are a by-product of the composition of the carton blank. Generally, the carton blank is cut and scored from a sheet of coated fiberboard material. The coated fiberboard material is usually composed of three layers, and may have a barrier layer juxtaposed between fiberboard layers. The exposed surfaces of this sheet are coated with a polymer material such as polyethylene. However, the coating does not extend to the edges which are thus left uncoated, and partially unprotected at least to moisture and sensitive to damage. When the carton is erected and partially formed, these raw paper edges are most prevalent at the bottom of the carton. If moisture is absorbed into the raw paper edges, the water may be absorbed throughout the fiberboard interior layer, which due to its cellulose-like nature, has a strong affinity for liquids. This absorption of moisture may compromise the integrity of the carton thereby rendering it defective.

This problem has yet to be directly addressed by the packaging industry. However, inventions directed to resolving the stability of cartons have been disclosed in the prior art. Mills et al, U.S. Pat. Nos. 5,482,204, and 5,588,943, respectively for a Carton Bottom Sealer and Carton Bottom Sealing Dies disclose cartons having an embossed inverse pyramidal bottom which is directed to providing greater stability to the filled carton and to reduce bulging of the carton. It should be noted, as shown in FIGS. 8 and 9 of the Mills et al Patents, that the end portions of the exposed raw paper edges of the bottom of the carton are not embossed, and therefore are susceptible to moisture absorption.

Fujikawa et al, U.S. Pat. No. 5,222,667, for a Container Made Of Paper-Base Laminate, similarly discloses a carton having an inverted V-shaped bottom to provide greater stability to the carton. As shown in FIG. 6 of the Fujikawa et al Patent, the raw paper edge of panel 27 is not inverted and is susceptible to moisture absorption since the V-shaped inversion begins at the raw paper edge and since the inversion must be centered to provide stability to the carton.

BRIEF SUMMARY OF THE INVENTION

The present invention resolves the problem of absorption of moisture through raw paperboard edges by providing a carton having the raw paperboard edges elevated in order to protect the raw paperboard edges and reduce the susceptibility of moisture absorption. The present invention is able to accomplish this without adversely affecting the carton.

One aspect of the present invention is a carton having bottom panels sealed together to form a sealed bottom with a plurality of raw paperboard edges exposed wherein all of the raw paperboard edges are elevated to prevent moisture absorption.

Another aspect of the present invention is a carton having bottom panels sealed together to form a sealed bottom with a plurality of raw paper edges exposed wherein all of the raw paper edges are elevated to prevent moisture absorption, and additional elevations are provided to counteract possible gravitational forces exerted on the bottom of the carton.

It is a primary object of the present invention to provide a carton having elevated raw paperboard edges on the bottom of the carton to prevent moisture absorption.

It is a further object of the present invention to provide a carton having all raw paperboard edges on the bottom of the carton elevated in order to prevent moisture absorption.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of one embodiment of a carton of the present invention.

Figure 1:
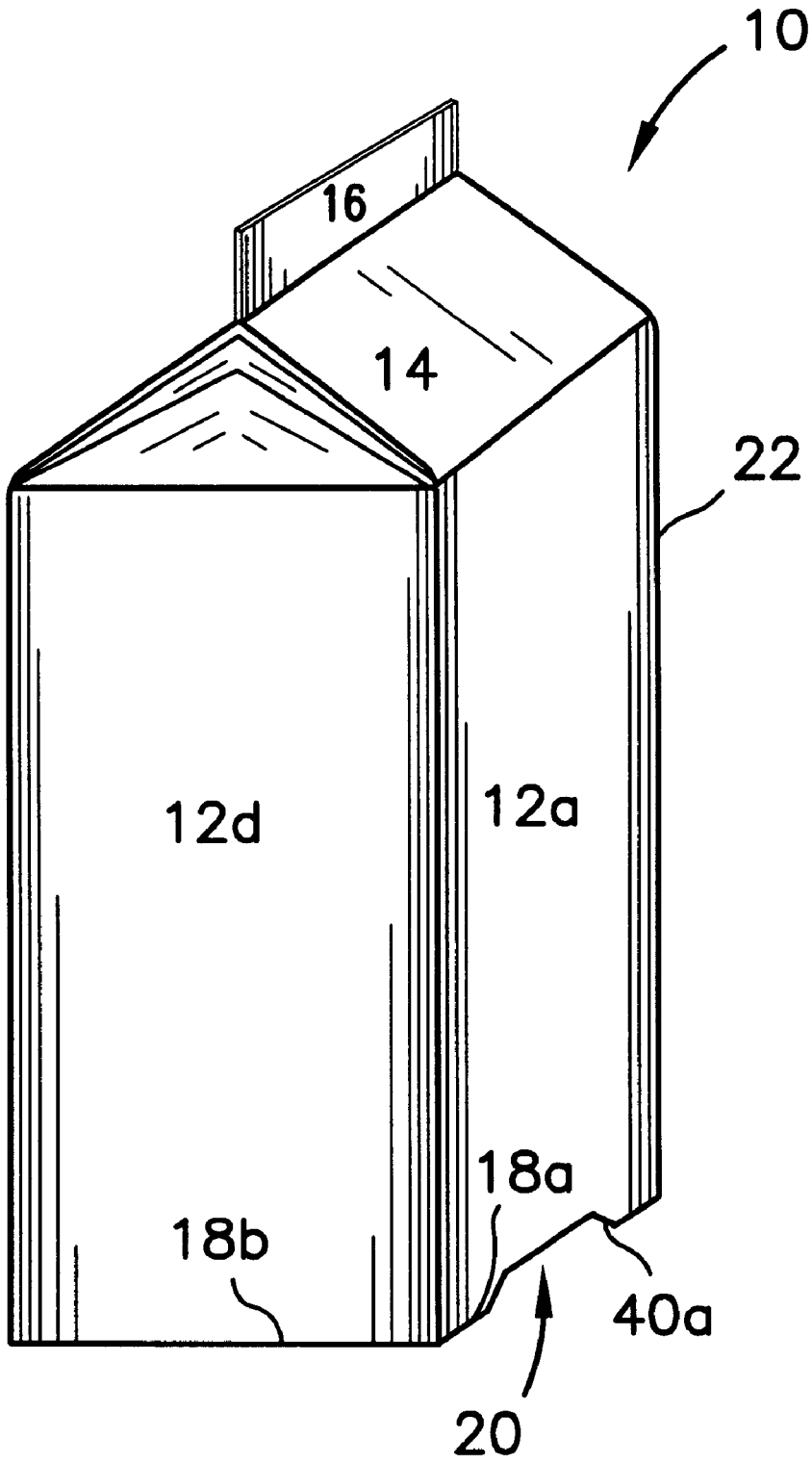
Figure 2:
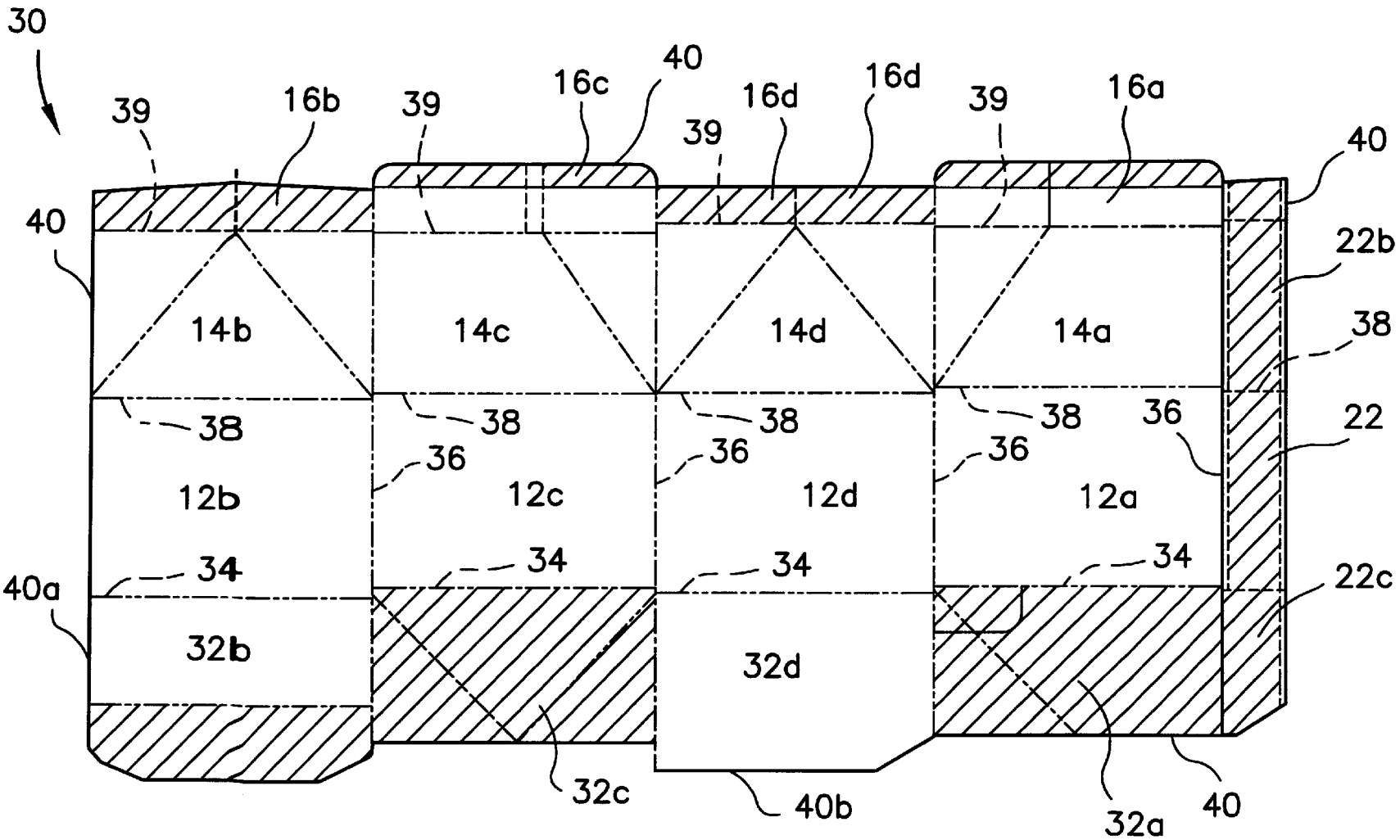

There is illustrated in FIG. 2 a plan view of a blank for the carton of FIG. 1.

Figure 3:
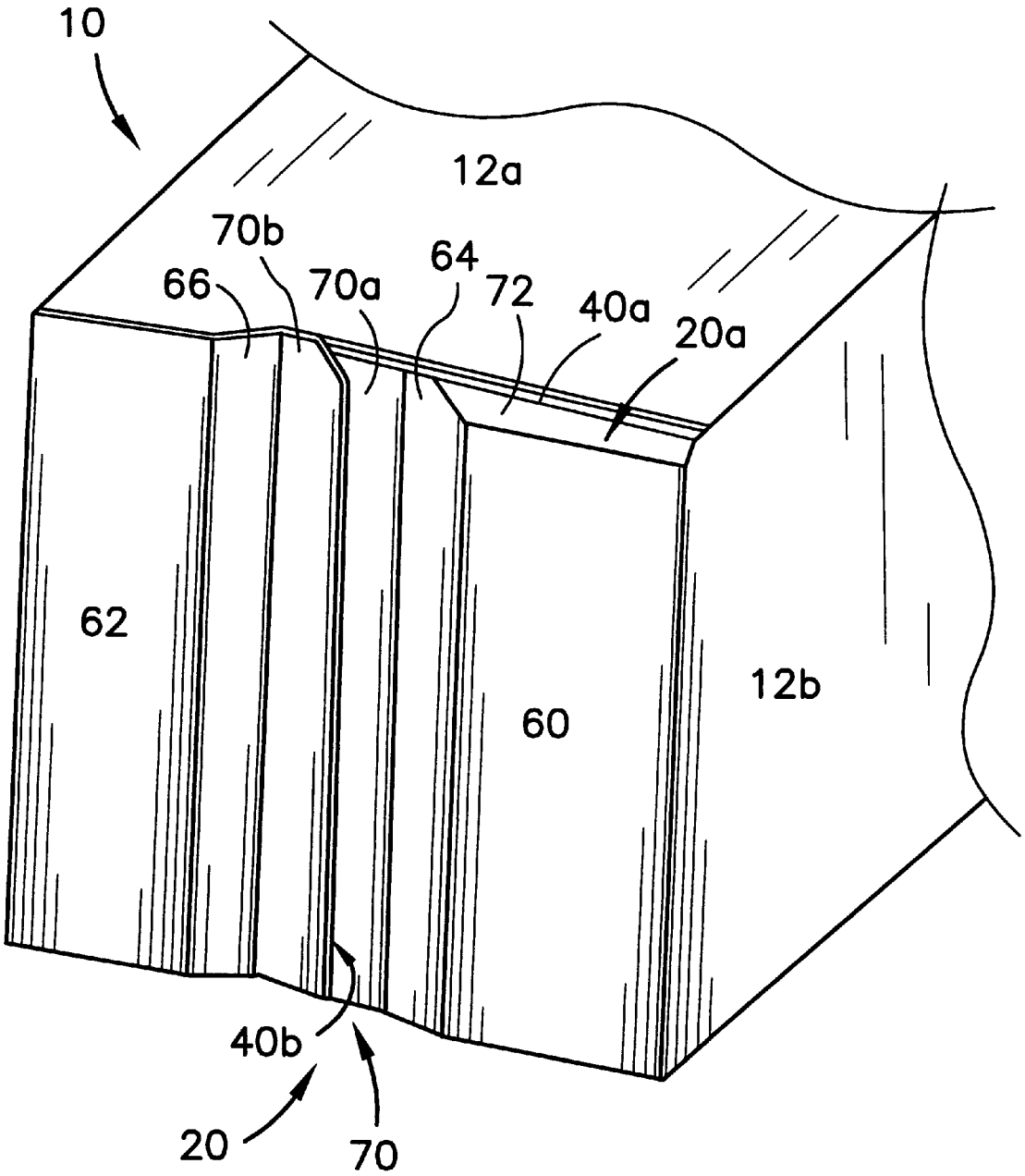

There is illustrated in FIG. 3 a bottom perspective view of one embodiment of a carton of the present invention.

Figure 4:
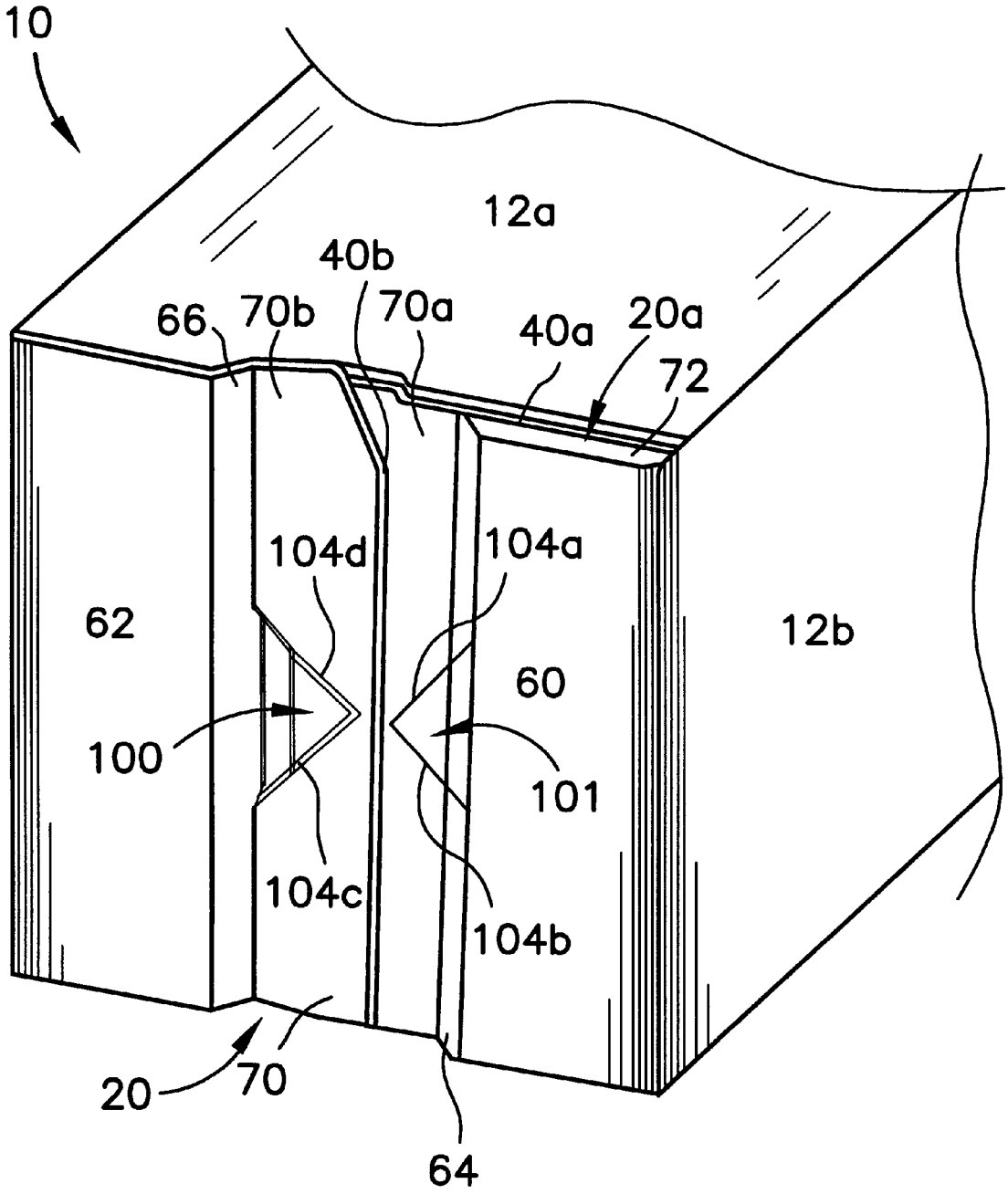

There is illustrated in FIG. 4 a bottom perspective of the preferred embodiment of a carton of the present invention.

DETAILED DESCRIPTION OF THE INVENTION

There is illustrated in FIG. 1 a carton 10 embodying the present invention. The carton 10 has a plurality of side panels 12*a* and 12*b*, a top panel 14, a top fin 16, bottom score lines 18*a* and 18*b* defining the bottom from the side panels 12*a* and 12*b*, and an elevated portion 20. A sealing panel 22, partially shown in FIG. 1, is connected to the side panel 12*a* and is folded over and sealed to the side panel 12*b*, not shown. The folding and sealing of the carton creates a raw paperboard edge which extends from the top 16 to the bottom of the carton 10 along this intersection of the sealing panel 22 and side panel 12*b*, top panel 14, top fin 16 and the bottom panel corresponding to side panel 12*d*.

FIG. 2 illustrates a blank 30 of the carton 10 of FIG. 1. The side panels 12*a–d* are separated from bottom panels 32*a–d* by bottom horizontal score lines 34 and each of the side panels 12*a–d* and bottom panels 32*a–d* are separated from each other by vertical score lines 36. The side panels 12*a–d* are separated from top panels 14*a–d* by top horizontal score lines 38. The top fin panels 16*a–d* are separated from top panels 14*a–d* by upper horizontal score line 39. The sealing panel 22 is separated from side panel 12*a* by a vertical score line 36. A top sealing panel 22*b* and a bottom sealing panel 22*c* further define sealing panel 22. The raw paperboard edge 40 extends along the entire perimeter of the carton blank 30. However, for purposes of this invention, the most important portions of the raw paperboard edge 40 are portions 40*a* and 40*b* which lie on the bottom of the carton. All other portions of the raw paperboard edge 40 are either covered by a coated panel, or are elevated above the surface when the blank 30 is formed into a carton 10. Thus, moisture absorption by these portions of the raw paperboard edge 40 is highly unlikely.

FIG. 3 shows a preferred embodiment of the present invention. The bottom of the carton 10 has the elevated portion 20 bounded by substantially planar portions 60 and 62. The planar portions 60 and 62 are substantially perpendicular to side panels 12*a,* 12*b* and 12*c* and 12*d,* not shown. The planar portions 60 and 62 contact a surface such as a conveyor belt on a packaging machine while the elevated portion 20 is elevated above the surface and any moisture thereon. The same applies during distribution of the carton whether in a crate or on a shelf at a store.

The elevated portion 20 is further defined by angled portions 64 and 66 and elevated planar portion 70. The elevated planar portion 70 is further defined as elevated planar portion 70*a* and elevated planar portion 70*b*. The elevated planar portion 70*a* substantially includes a portion of panel 32*b* while elevated planar portion 70*b* includes a portion of panel 32*d*. The exposed raw paperboard edge 40*b* traverses the bottom of the carton 10, extending from the end of panel 12*a* to the end of panel 12*c,* not shown. Likewise, the elevated portion 20 traverses the bottom of the carton 10. Preferably, the elevated portion 20 is centered on the bottom of the carton 10 with planar portions 60 and 62 being equal in area to each other. However, those skilled in the pertinent art will recognize that planar portions 60 and 62 may be unequal and elevated portion 20 may be uncentered without departing from the scope and spirit of the present invention.

It is readily apparent that elevated portion 70*a,* angled portion 64 and planar portion 60 all are part of bottom panel 32*b*. Also, elevated portion 70*b,* angled portion 66 and planar portion 62 all are part of bottom panel 32*d*.

The exposed edge 40*a* is substantially perpendicular to exposed edge 40*b*. A side elevated/angled portion 20*a* elevates this exposed edge 40*a* thereby preventing moisture absorption as with exposed edge 40*b*. The side elevated/angled portion 20*a* has an angled portion 72 which engages planar portion 60, side panel 12*a,* and angled portion 64. Those skilled in the art will recognize that the exposed raw edges may be elevated in a similar fashion without departing from the scope and content of the present invention.

A preferred embodiment of the carton of the present invention is shown in FIG. 4. The carton 10 of FIG. 4 is similar to the carton 10 of FIG. 3 except that approximately in the center of the elevated portion 20 are secondary elevated portions 100 and 101. The secondary elevated portions 100 and 101 prevent loss of elevation in the center of the bottom of the carton 10 during transportation from a packaging machine to the retailer/wholesaler to the consumer. As is apparent, the center of the bottom of the carton 10 is most susceptible to deelevation from the weight of the product. The weight of the product in the carton 10 is focused on the center of the bottom of the carton 10, and thus it is necessary to provide greater elevation in this area. This greater elevation is provided by the secondary elevated portions 100 and 101 which compensate for gravitational forces exerted by the product on the center of the bottom of the carton 10.

In a preferred embodiment, the secondary elevated portions 100 and 101 are triangular in shape with apices 102*a–b* facing the center of the bottom of the carton 10. The secondary elevated portions 100 and 101 are substantially contained within elevated planar portions 70*a* and 70*b*. However, there is a transition for each secondary elevated portions 100 and 101 to angled portions 66 and 64, respectively. Alternatively, the triangular shaped embodiment of the secondary elevated portions 100 and 101 may be rotated any degree from 1–360 degrees, about apices 102*a–b* while not departing from the scope and spirit of the present invention. Thus, the secondary elevated portions 100 and 101 may lie entirely within elevated planar portion 70*b* and 70*a,* respectively.

In the preferred embodiment, the secondary elevated portions 100 and 101 are partially defined by secondary angled portions 104*a–d*. The secondary angled portions 104*a–d* form a transition from the secondary elevated portions 100 and 101 to the elevated planar portions 70*b* and 70*a*.

In an alternative embodiment not shown, the carton 30 of FIG. 4 may only have one secondary elevated portion 100 or 101 which may be disposed on either of planar portion 70*a* or 70*b*.

The bottom of the carton 10 is usually formed on a mandrel of a form, fill and seal packaging machine, not shown. The carton blanks 30 are fed from a magazine, not shown, to a bottom forming station of the machine, not shown. During the transfer from magazine to bottom forming station, the carton blank is erected. On the bottom forming station, the bottom panels are pretreated if necessary, and then heat sealed together to form the bottom. This is accomplished by pressing against the bottom panels as they lie on the mandrel. In order to achieve the elevated bottom of the present invention, one may have a special sealing plate and mandrel which allows for the elevated bottom of the present invention. Such a sealing plate and mandrel are set forth in co-pending U.S. patent application Ser. No. 09/128,183 (Corporate Docket Number TRX-0565), filed on Aug. 3, 1998, and entitled Forming Apparatus For An Elevated Bottom Carton, which relevant parts are hereby incorporated by reference.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

I claim as my invention:

1. A carton having a plurality of side panels and a plurality of bottom panels corresponding thereto, the plurality of bottom panels folded and sealed together to form a sealed bottom, the carton having a first exposed edge traversing the bottom of the carton and a second exposed edge substantially perpendicular to the first exposed edge, the carton comprising:

a primary elevated portion extending along a length of the first exposed edge, the elevated portion being inverted into the carton;

a first substantially planar portion defined by one side of the elevated portion and the ends of the side panels corresponding thereto, the first substantially planar portion being substantially perpendicular to the corresponding side panels;

a second substantially planar portion defined by an other side of the elevated portion and the ends of the side panels corresponding thereto, the second substantially planar portion being substantially perpendicular to the corresponding side panels; and a side angled portion extending along the length of the second exposed edge, the side angled portion being inverted into the carton forming an obtuse angle with one of said first and second substantially planar portions.

2. The carton according to claim 1 including a first angled portion extending between the primary elevated portion and the first substantially planar portion, and a second angled portion extending between the second substantially planar portion and the primary elevated portion.

3. The carton according to claim 2 wherein the primary elevated portion further comprises a first elevated planar portion engaging the first angled portion, and a second elevated planar portion engaging the second angled portion, the first elevated planar portion lying on a first plane and the second elevated planar portion lying on a second plane that is not coplanar with the first plane.

4. The carton according to claim 1 wherein the first and second substantially planar portions are substantially equal in area.

5. The carton according to claim 1 wherein the first exposed edge is asymmetrically disposed on a center of the primary elevated portion.

6. The carton according to claim 1 including a first secondary elevated portion disposed within the primary elevated portion, the secondary elevated portion having an elevation greater than an elevation of the primary elevated portion.

7. The carton according to claim 6 including a plurality of secondary angled portions forming a transition from the first secondary elevated portion to the primary elevated portion.

8. The carton according to claim 6 including a second secondary elevated portion disposed on the primary elevated portion in opposing relation to the secondary elevated portion.

9. The carton according to claim 1 wherein the wherein the primary elevated portion defines a plane that is generally parallel to and spaced from a plane defined by the first substantially planar portion and a plane defined by the second substantially planar portion.

10. A carton having a plurality of side panels and a plurality of bottom panels corresponding thereto, the plurality of bottom panels folded and sealed together to form a sealed bottom, the last folded and sealed bottom panel having a first exposed edge traversing the bottom of the carton and a penultimate folded and sealed bottom panel having a second exposed edge substantially perpendicular to the first exposed edge, the carton comprising:

a primary elevated portion extending along the length of the first exposed edge, the primary elevated portion being inverted into the carton;

a side elevated portion extending along the length of the second exposed edge, the side elevated portion being inverted into the carton;

a first substantially planar portion defined by one side of the primary elevated portion and the ends of the side panels corresponding thereto, the first substantially planar portion being substantially perpendicular to the corresponding side panels;

a second substantially planar portion defined by an other side of the primary elevated portion and the ends of the side panels corresponding thereto, the second substantially planar portion being substantially perpendicular to the corresponding side panels; said side elevated portion forming an obtuse angle with one of said first and second substantially planar portions; and a first secondary elevated portion disposed within the primary elevated portion, the secondary elevated portion being inverted into the carton a depth greater than a depth of the primary elevated portion.

11. The carton according to claim 10 wherein the first secondary elevated portion is triangular in shape.

12. The carton according to claim 10 further comprising a plurality of secondary angled portions forming a transition from the secondary elevated portion to the primary elevated portion.

13. The carton according to claim 10 wherein the primary elevated portion further comprises a first angled portion extending therefrom to the first substantially planar portion, and a second angled portion extending from the primary elevated portion to the second substantially planar portion.

14. The carton according to claim 13 wherein the primary elevated portion further comprises a first elevated planar portion engaging the first angled portion, and a second elevated planar portion engaging the second angled portion, the first elevated planar portion lying on a first plane and the second elevated planar portion lying on a second plane, the first and second planes being non-coplanar.

15. The carton according to claim 14 further comprising a second secondary elevated portion disposed on the second elevated planar portion of the primary elevated portion and opposite of the first secondary elevated portion, the second secondary elevated portion disposed on the first elevated planar portion.

16. The carton according to claim 13 wherein the side elevated portion engages the second angled portion.

17. The carton according to claim 10 wherein the first secondary elevated portion is disposed at a center of the bottom of the carton.

18. A carton having a plurality of side panels and a plurality of bottom panels corresponding thereto, the plurality of bottom panels folded and sealed together to form a sealed bottom, the last folded and sealed bottom panel having a first exposed edge traversing the bottom of the carton and a penultimate folded and sealed bottom panel having a second exposed edge substantially perpendicular to the first exposed edge, the carton comprising:

a primary elevated portion extending along a length of the first exposed edge, the primary elevated portion being inverted into the carton;

a side elevated portion extending along the length of the second exposed edge, the side elevated portion being inverted into the carton;

a first substantially planar portion defined by one side of the primary elevated portion and the ends of the side panels corresponding thereto, the first substantially planar portion being substantially perpendicular to the corresponding side panels;

a second substantially planar portion defined by another side of the primary elevated portion and the ends of the side panels corresponding thereto, the second substantially planar portion being substantially perpendicular to the corresponding side panels; said side elevated portion forming an obtuse angle with one of said first and second substantially planar portions;

a first secondary elevated portion disposed within the primary elevated portion, the first secondary elevated portion being inverted into the carton a depth that is greater than a death of the primary elevated portion; and a second secondary elevated portion disposed within the primary elevated portion and opposite the first secondary elevated portion, the second secondary elevated portion being inverted into the carton a depth that is greater than a depth of the primary elevated portion.

19. The carton according to claim 18 wherein the primary elevated portion further comprises a first angled portion extending therefrom to the first substantially planar portion, and a second angled portion extending from the primary elevated portion to the second substantially planar portion.

20. The carton according to claim 18 further comprising a plurality of secondary angled portions forming a transition from the first and second secondary elevated portions to the primary elevated portion.

21. The carton according to claim 18 wherein the primary elevated portion further comprises a first elevated planar portion engaging the first angled portion, and a second elevated planar portion engaging the second angled portion, the first elevated planar portion lying on a first plane and the second elevated planar portion lying on a second plane, the first and second planes being non-coplanar.

* * * * *